United States Patent [19]

Hashimoto et al.

[11] Patent Number: 5,071,502

[45] Date of Patent: Dec. 10, 1991

[54] HEAT-SENSITIVE RECORDING MATERIAL

[75] Inventors: Ken Hashimoto; Nobuyuki Torigoe, both of Kanagawa, Japan

[73] Assignee: Fuji Xerox Co., Ltd., Tokyo, Japan

[21] Appl. No.: 657,272

[22] Filed: Feb. 19, 1991

Related U.S. Application Data

[63] Continuation of Ser. No. 855,283, Apr. 24, 1986, abandoned.

[30] Foreign Application Priority Data

Apr. 24, 1985 [JP] Japan ..... 60-86538
Apr. 24, 1985 [JP] Japan ..... 60-86539

[51] Int. Cl.[5] ..... B41M 5/025; B41M 5/26

[52] U.S. Cl. ..... 156/234; 156/235; 156/237; 156/240; 428/195; 428/413; 428/474.4; 428/480; 428/488.1; 428/500; 428/521; 428/913; 428/914

[58] Field of Search ..... 156/234, 235, 237, 239, 156/240; 428/195, 207, 413, 474.4, 480, 484, 488.1, 488.4, 500, 521, 913, 914

[56] References Cited

U.S. PATENT DOCUMENTS

| | | | |
|---|---|---|---|
| 3,941,596 | 3/1976 | Heiart | 427/148 |
| 4,292,104 | 9/1981 | Heimbach et al. | 427/148 |
| 4,322,467 | 3/1982 | Heimbach et al. | 427/148 |
| 4,472,537 | 9/1984 | Johnson et al. | 524/292 |
| 4,474,859 | 10/1984 | Oshima et al. | 428/211 |
| 4,511,602 | 4/1985 | Margarum et al. | 156/234 |
| 4,592,946 | 6/1986 | Shuman | 428/200 |

FOREIGN PATENT DOCUMENTS

| | | | |
|---|---|---|---|
| 10033464 | 8/1981 | European Pat. Off. | 428/913 |
| 97493 | 1/1984 | European Pat. Off. | 346/227 |
| A10098357 | 7/1984 | European Pat. Off. | 346/227 |
| 137741 | 4/1985 | European Pat. Off. | 346/227 |
| 49-103639 | of 0000 | Japan | 503/227 |
| 0144751 | 12/1978 | Japan | 428/488.1 |
| 0101094 | 6/1983 | Japan | 428/488.1 |
| 993141 | 5/1965 | United Kingdom | 346/227 |
| 2010515 | 6/1979 | United Kingdom | 346/227 |
| 2069159 | 8/1981 | United Kingdom | 346/227 |
| 2099602 | 12/1982 | United Kingdom | 428/914 |
| 2150310 | 6/1985 | United Kingdom | 346/227 |
| A2161824 | 1/1986 | United Kingdom | 346/227 |

*Primary Examiner*—Bruce H. Hess
*Attorney, Agent, or Firm*—Sughrue, Mion, Zinn, Macpeak & Seas

[57] ABSTRACT

A heat-sensitive recording material is disclosed, comprising a support having provided thereon a hot-melt heat-sensitive ink material layer, wherein said heat-sensitive ink material comprises an amorphous polymer and a coloring material as main components and a releasing agent as an optional but rather preferred component, said amorphous polymer being present in an amount of at least 50% by weight based on solid components of the heat-sensitive ink material. The recording material is excellent in color reproducibility, resolving power, recording sensitivity, transfer properties and fixing properties.

19 Claims, No Drawings

HEAT-SENSITIVE RECORDING MATERIAL

This is a continuation of application Ser. No. 06/855,283 filed Apr. 24, 1986, now abandoned.

FIELD OF THE INVENTION

This invention relates to an image recording material with which heat-sensitive transfer recording is effected upon heating correspondingly to signals applied by means of a thermal head, a laser beam or flash light or by directly passing electric signals.

BACKGROUND OF THE INVENTION

A number of heat-sensitive recording systems have hitherto been proposed, in which changes of materials in physical properties or chemical reactivity induced by heat energy are utilized. Inter alia, extensive studies have recently been directed to improvements in heat-sensitive color forming recording systems utilizing color forming reaction between leuco dyes, e.g., Crystal Violet Lactone, fluoran compounds, spiropyran compounds, etc., and phenolic compounds, e.g., bisphenol A, or other organic or inorganic acids, or thermal reaction between organic acid metal salts and organic reducing agents, e.g., phenols, metal sulfides, organic chelating agents or organic sulfur compounds; and heat-sensitive transfer recording systems utilizing thermal change of physical properties of the materials, such as heat melting property, heat sublimation property, etc., to transfer inks or coloring materials to a material on which a record is made, e.g., paper.

In particular, the latter heat-sensitive transfer recording system has been applied to printers, facsimiles, copying machines, and the like because of their advantages, such as possibility of recording on paper, satisfactory light-fastness, stability and preservability of a recorded image, high reliability attributed to a simple recording mechanism, and the like.

However, the system in which dyes are sublimed by heat has problems in terms of recording sensitivity, preservation stability of a recording material, fixing stability and light-fastness of a recorded image, and so on, although it enables reproduction of continuous gradation. According to the system in which inks are heat-melted according to signals given and transferred to paper, etc., the above problems can be somewhat solved. However, since this system usually employs a crystalline wax having a low melting point as a binder of a heat-sensitive ink layer, heat application causes diffusion of such a crystalline wax in the recording material, resulting in reduced resolving power or reduced intensity of a transferred and fixed image. Moreover, crystalline waxes have defect in that it is difficult to obtain clear images due to light scattering in the crystalline phase.

More specifically, in order to obtain a clear color image, especially a pictorial image in full color, by printing of ink materials one after another, magenta, yellow and cyan ink materials are generally used, and each of these ink materials is printed in layers to form a mixed color composed of two of them (hereafter referred to as "2-color (cyan, magenta, yellow)") or a mixed color composed of the three ink materials (hereafter referred to as "3-color (cyan, magenta, yellow)"). For instance, in obtaining a 2-color (cyan, magenta, yellow) by printing two kinds of ink materials in layers, a color difference between the intended color and the 2-color (cyan, magenta, yellow) actually obtained is decided by transparency of the ink materials used. In this case, if at least the ink material, or a binder layer in a strict sense, that is printed as an upper layer has satisfactory transparency, reflected light from the whole ink layer approximates to reflected light of the 2-color (cyan, magenta, yellow) attributed to the characteristics of the pigments per se, to thereby achieve satisfactory color reproducibility.

It is known to use resins as binder components of a heat-sensitive ink layer as disclosed in Japanese Patent Application (OPI) Nos. 87234/79 and 98269/81, etc. (the term "OPI" as herein used means "unexamined published application"). However, unlike the above-described waxes which are used as binders for heat-sensitive ink materials, these resins are used for improving ink fixing property or durability. There is no technical disclosure in these publications with respect to transparency of binder components for the purpose of color reproduction.

SUMMARY OF THE INVENTION

Accordingly, an object of this invention is to provide a heat-sensitive transfer recording material which enables clear color reproduction.

Another object of this invention is to provide a heat-sensitive transfer recording material having satisfactory resolving power.

A further object of this invention is to provide a heat-sensitive transfer recording material having satisfactory recording sensitivity and transfer and fixing properties.

As a result of extensive and intensive investigations, it has now been found that the above objects of this invention can be accomplished by altering a binder for heat-sensitive ink materials from the conventional crystalline wax-based binder to a substantially amorphous transparent polymer. It has further been found that addition of a small amount of a releasing agent to the heat-sensitive ink material further improves recording sensitivity, image quality and, in particular, resolving power. The present invention has been completed based on these findings.

The present invention relates to a heat-sensitive recording material comprising a support having provided thereon a hot-melt heat-sensitive ink material layer, wherein said heat-sensitive ink material comprises an amorphous polymer and a coloring material as main components and a releasing agent as an optional but rather preferred component, said amorphous polymer being present in an amount of at least 50% by weight based on nonvolatile components, i.e., solid components, of the heat-sensitive ink material.

DETAILED DESCRIPTION OF THE INVENTION

The amorphous polymer which can be used in the present invention is a substantially amorphous transparent polymer which does not essentially show a clear melting point unlike crystalline polymers, e.g., polyethylene terephthalate, which have conventionally been used as a support for heat-sensitive recording materials.

Waxes conventionally employed as binders for heat-sensitive ink materials include paraffin wax, carnauba wax, montan wax, beeswax, Japan wax, candelilla wax, low-molecular weight polyethylene, α-olefin oligomers and copolymers or modified products of these waxes. The binder is mixed and dispersed with dyes, pigments, etc. together with, if necessary, a mineral oil, e.g., spindle oil, a vegetable oil, e.g., linseed oil, tung oil, etc., a plasticizer, e.g., dioctyl phthalate and dibutyl phthalate, a higher fatty acid, e.g., oleic acid and stearic acid, or metal salts, amide or other derivatives thereof, and the like. The resulting mixture is then coated on thin plastic films or condenser paper to produce heat-sensitive transfer recording materials.

Since the above-mentioned waxes are crystalline, they have relatively clear melting points in a temperature range of from about 50° C. to about 150° C. and undergo steep change from a solid phase to a liquid phase upon heating to their melting point or higher temperatures, finally to a low-viscosity liquid of about $10^{-2}$ to about 10 poises at temperatures higher than the melting point by about 30° C. To the contrary, amorphous polymers do not essentially have melting points and gradually change from a solid phase into a liquid phase across the border of a glass transition temperature (Tg) when heated. The viscosity change during this phase transition basically follows the WLF or Andrade's viscosity formula, and, in general, the viscosity decreases only to about $10^3$ to $10^5$ poises at the lowest even at a temperature higher than Tg by about 50° C. In the case of heat-sensitive transfer recording, the transfer and fixing sensitivity are basically governed by melt viscosity or melt viscoelasticity of the binder used. Therefore, it is considered that use of amorphous polymers as a binder of heat-sensitive ink materials is disadvantageous from the standpoint of sensitivity. Nevertheless, it has surprisingly been found that image quality and image stability can be markedly improved without impairing sensitivity by using an amorphous polymer having a specific molecular weight and a specific glass transition temperature and, if desired, a releasing agent in combination.

That is, the heat-sensitive recording materials according to the present invention wherein a specific amorphous polymer is used as a binder for a heat-sensitive ink layer in an amount of at least 50% by weight based on solid components of the heat-sensitive ink material are free from scattering of transmitted light which is caused by the conventional crystalline polymer binder and can, therefore, maintain transparency of the binder layer which is inevitable for obtaining a clear color image, especially by printing ink materials in layers.

Use of polymers as a binder is generally considered disadvantageous from the viewpoint of recording sensitivity. According to the present invention, however, thermal diffusion of the conventional waxes in a binder layer can be prevented to assure a high resolving power while retaining the recording sensitivity level as attained in the conventional wax type heat-sensitive recording materials by controlling two factors of an amorphous polymer, i.e., number average molecular weight and a glass transition temperature, preferably taking advantage of the effect of the releasing agent to lower surface energy at the interface between the heat-sensitive ink material and the support. Further, the present invention makes it possible to achieve inking with excellent fixing property utilizing flexibility and abrasion resistance inherent to polymers.

The amorphous polymers inclusive of oligomers which can be used in the present invention preferably have a number average molecular weight ($\overline{M}n$) of not more than about 10,000, and more preferably about 5,000 or less, as determined by gel permeation chromatography (calculated as polystyrene) and a glass transition temperature (Tg) of not less than about 40° C., and more preferably of from about 50° to 80° C., as determined by differential scanning calorimetry (DSC). These amorphous polymers are used as a binder in an amount of at least 50% by weight, preferably 70% by weight or more, based on solid components in the heat-sensitive ink material.

If the amorphous polymer content is less than 50% by weight based on solid components in the heat-sensitive ink material, transparency of the heat-sensitive ink material is seriously deteriorated so that satisfactory color reproducibility cannot be assured. The amorphous polymer content of 50% by weight or more, and particularly 70% by weight or more, exhibits high transparency to produce excellent effects on color reproduction particularly by printing of ink materials one after another. This is ascribable to a difference in the proportion of crystalline components contained in the whole heat-sensitive ink material. It is considered that an increased proportion of crystalline components in the heat-sensitive ink material increases the degree of light scattering due to crystals, thus resulting in deteriorated transparency. Further, if the amorphous polymer has a Tg of lower than 40° C., the resulting heat-sensitive ink material is liable to cause blocking and comes to lack stability during preservation or on use. On the other hand, when the Tg exceeds 80° C., the heat-sensitive ink material exhibits satisfactory heat stability but have a reduced sensitivity and are used only for special applications. Even if the Tg falls within the above range, it was experimentally confirmed that sensitivity is reduced when the molecular weight of the amorphous polymer is too high. This reduction in sensitivity is assumed ascribable to intermolecular cohesive force due to entanglement of molecular chains. It was also confirmed that satisfactory transfer and fixing properties can be obtained with number average molecular weights of not more than about 10,000.

A weight average molecular weight ($\overline{M}w$) of the amorphous polymer can be set depending on utility of the recording material. In the case of obtaining a binary transfer image (i.e., mono tone image), it is desirable, as in the case of the conventional wax type inks, to make molecular weight distribution narrow by setting a weight average molecular weight not to exceed about 40,000, and preferably not to exceed about 10,000, to thereby make the softening characteristics of the amorphous polymer sharply changed within a certain temperature range. On the other hand, when it is intended to obtain continuous gradation, to from a transfer images having more than two tones, or to repeatedly use the recording material, it is desirable to use an amorphous polymer having softening characteristics gradually changed in accordance with applied energy. In the case, the weight average molecular weight of the amorphous polymer is not necessarily required to be small and may be set at about 40,000 or more. Even using such an amorphous polymer, however, a binary transfer image can also be obtained. A molecular weight distribution is not always required to have a single peak and may have a plurality of molecular weight peaks. Cross-linked or branched polymers may also be used in combination. It should be noted, however, that weight average molecular weights higher than about 10,000, and particularly higher than 40,000, are disadvantageous in view of the sensitivity.

As a matter of course, the chemical composition and structure of the amorphous polymers influence characteristics of the heat-sensitive ink material, but not so decisively as the above-described factors, i.e., molecular weight and Tg. Therefore, any polymer binder is basically applicable as a heat-sensitive ink material as long as the molecular weight and Tg thereof are within the above-specified ranges.

Examples of usable amorphous polymers include homopolymers or copolymers of styrene or its derivatives or substituted compounds thereof (e.g., styrene, vinyltoluene, α-methylstyrene, 2-methylstyrene, chlorostyrene, vinyl benzoate, sodium vinylbenzenesulfonate, aminostyrene, etc.) and homopolymers or copolymers of vinyl monomers, such as methacrylic acid and esters thereof (e.g., methyl methacrylate, ethyl methacrylate, butyl methacrylate, hydroxyethyl methacrylate, etc.) acrylic acid and esters thereof (e.g., methyl acrylate, ethyl acrylate, butyl acrylate, 2-ethylhexyl acrylate, etc.), dienes (e.g., butadiene, isoprene, etc.), acrylonitrile, vinyl ethers, maleic acid, maleic esters, maleic anhydride, cinnamic acid, vinyl chloride, vinyl acetate, etc.

Condensation resins which can be used as amorphous polymers include polyester resins obtained by polycondensation of saturated dibasic acids (e.g., phthalic acid, phthalic anhydride, isophthalic acid, terephthalic acid, hexahydrophthalic anhydride, malonic acid, succinic acid, glutaric acid, adipic acid, sebacic acid, etc.) or unsaturated dibasic acids (e.g., maleic anhydride, fumaric acid, itaconic acid, tetrahydrophthalic anhydride, etc.) and diols (e.g., ethylene glycol, 1,2-propylene glycol, 1,6-hexanediol, bisphenol A, a bisphenol A-propylene oxide adduct, a bisphenol A-ethylene oxide adduct, etc. In these condensed resins, trifunctional compounds, e.g., trimellitic acid, glycerin, trimethylolpropane, etc., may be used to obtain branched or crosslinked polyesters. Similarly, in the aforesaid vinyl resins, polyfunctional monomers, e.g., divinylbenzene, etc., can be used to form crosslinked polymers.

Additional examples of usable amorphous polymers are polycarbonates, polyamides, epoxy resins, polyurethanes, silicone resins, fluorine-containing resins, phenolic resins, terepene resins, petroleum resins, hydrogenated petroleum resins, alkyd resins, ketone resins, cellulose derivatives, and the like.

When the amorphous polymer to be used is a copolymer, the copolymer structure can be selected appropriately from random copolymers, alternating copolymers, graft copolymers, block copolymers, interpenetrated copolymers, and the like in conformity with the end use. In case of using a mixture of two or more polymers, the mixing can be carried out by mechanical mixing, such as melt mixing, solution mixing, emulsion mixing, etc., as well as by polymerization of two or more polymerization systems in the same vessel, multi-stage polymerization, and the like.

The releasing agent which can be used as a binder component in combination with the above-described amorphous polymer is an organic substance or an organic or inorganic low-molecular polymer which is solid at room temperature, whose melting point as measured by DSC or softening point as measured by a ring and ball method ranges from 50° to 200° C., and preferably from 60° to 150° C., and which abruptly becomes a low-viscosity liquid at a temperature exceeding the melting point or softening point because of its relatively low surface energy. When the melting point or softening point is lower than 50° C., the heat-sensitive ink material has insufficient stability during preservation or on use. With melting points exceeding 200° C., addition of such a substance does not exhibit substantial effects when heat energy is applied in accordance with a general heat-sensitive recording system.

In the present invention, preferred examples of the releasing agents include those having such a low viscosity that the melt viscosity suddenly decreases to about 10 poises or less, and preferably to about 1 poise or less in a temperature range of from about 100° to 180° C. and/or such a low surface energy as having a critical surface tension of about 40 dyn/cm or less, and preferably about 30 dyn/cm or less.

Specific examples of such releasing agents are fatty acids, e.g., palmitic acid, stearic acid, etc., and derivatives thereof such as metal salts (e.g., zinc stearate), esters or partially saponified products thereof, amides, etc.; higher alcohols; polyhydric alcohol derivatives, such as esters; waxes, e.g., paraffin wax, carnauba wax, montan wax, beeswax, Japan wax, candelilla wax, etc.; polyolefins having a viscosity average molecular weight of from about 1,000 to 10,000, e.g., low-molecular weight polyethylene, polypropylne or polybutylene, etc.; low-molecular weight copolymers of olefins or α-olefins and organic acids (e.g., maleic anhydride, acrylic acid, methacrylic acid, etc.) or vinyl acetate, etc.; low-molecular weight polyolefin oxides; halogenated polyolefins; homopolymers of methacrylic esters or acrylic esters having a long-chain alkyl side chain (e.g., lauryl methacrylate, stearyl methacrylate, etc.) or acrylic esters or methacrylic esters having a perfluoro group, or copolymers thereof with vinyl monomers (e.g., styrenes); low-molecular weight silicone resins, such as polydimethylsiloxane, polydiphenylsiloxane, etc., and silicone-modified organic substances; cationic surface active agents such as ammonium salts or pyridinium salts having a long-chain aliphatic group; an anionic, nonionic or perfluoro surface active agents having a long-chain aliphatic group; and the like. These releasing agents may be used individually or in combination of two or more thereof.

These releasing agents are melted upon heating to lower excessive cohesive force or adhesive force among molecules of the amorphous polymer, which is a main binder component, and/or between the amorphous polymer and a support due to their low cohesive force and/or low surface energy. As a result, recording can be achieved with lower energy, and recording sensitivity and image quality, in particular, resolving power can be improved.

Since many of the releasing agents are crystalline, addition in excess causes light scattering due to crystals, which leads to reduction in transparency and, in turn, deterioration in color reproducibility. Further, the releasing agent, when added in excess, causes reduction of ink fixing property onto materials, such as paper, and also reduction in resolving power, which results in an enlarged image. To the contrary, if the amount of the releasing agents is too small, their function cannot be exerted effectively. Accordingly, the weight ratio of the amorphous polymer to the releasing agent in the heat-sensitive ink material preferably ranges from about 70/30 to about 99/1, and more preferably from about 80/20 to about 95/5. Within the above-recited range, the heat-sensitive ink material according to the present invention can achieve its object in the most effective way without deteriorating color reproducibility. Heat-sensitive ink materials containing less than 70% by weight of the amorphous polymer based on the binder components may be of practical use, but the resulting image quality tends to be degraded as mentioned above.

Mixing of the releasing agent with other ink components, such as amorphous polymers, may be attended by chemical bonding. In particular, dispersion stability of the releasing agent can be improved utilizing the reaction or interaction between an active group of the amorphous polymer and an active group of the releasing agent. Further, it is effective that a monomer or monomers for the amorphous polymer is/are polymerized or condensation-polymerized in the presence of the releasing agent to obtain an amorphous polymer to which the releasing agent is grafted or an amorphous polymer having uniformly dispersed therein the releasing agent.

The heat-sensitive recording material in accordance with the present invention may further contain various additives either inside or outside the heat-sensitive ink material. Such additives include antistatic agents, electrical conductivity imparting agents, antioxidants, thermal conductivity-improving agents, magnetic materials, strong dielectrics, antiseptics, perfumes, anti-blocking agents, reinforcing fillers, parting agents, foaming agents, subliming substances, infrared absorbents, and so on. Care should be taken, however, that the amount of these additives be within such a range that the above-described amorphous polymer occupies at least 50% by weight, and preferably 70% by weight or more, based on solid components in the whole heat-sensitive ink material.

The coloring material which can be used in the present invention includes dyes and pigments conventionally known for printing inks or other coloring purposes, such as black dyes and pigments, e.g., carbon black, oil black, graphite, etc.; acetoacetic acid arylamide type monoazo yellow pigments (First Yellow type), e.g., C.I. Pigment Yellow 1, 3, 74, 97 or 98, etc.; acetoacetic acid arylamide type disazo yellow pigments, e.g., C.I. Pigment Yellow 12, 13 or 14, etc.; yellow dyes, e.g., C.I. Solvent Yellow 19, 77 or 79, C.I. Disperse Yellow 164, etc.; red or deep red pigments, e.g., C.I. Pigment Red 48, 49:1, 53:1, 57:1, 81, 122 or 5, etc.; red dyes, e.g. C.I. Solvent Red 52, 58 or 8, etc.; blue dyes and pigments, such as copper phthalocyanine or its derivatives or modified compounds, e.g., C.I. Pigment Blue 15:3, etc.; and colored or colorless subliming dyes.

These coloring materials may be used alone or in combination of two or more thereof. It is possible, of course, to mix them with extender pigments or white pigments for controlling color tone. In order to improve dispersing property of these coloring materials in the binder component(s), they may be treated with surface active agents, coupling agents, such as silane coupling agents, or polymers, or polymeric dyes or polymeric graft pigments may be employed.

The heat-sensitive transfer recording materials of the present invention can be obtained by coating the heat-sensitive ink material comprising the amorphous polymer, the coloring material and, if desired, the releasing agent and the aforesaid additives on a support.

The heat-sensitive ink material can be prepared by dissolving or dispersing the binder component(s) in a solvent or a dispersing medium capable of stable dispersing it (them) to form a solution or a dispersion and mixing with other components in a mixer, e.g., a ball mill, a sand mill, attritor, a three-roll mill, etc.

The components may be melt-mixed in a hot three-roll mill, a hot press kneader, a Banbury mixer, etc.

The heat-sensitive ink material may also be prepared by polymerizing a monomer or monomers for the amorphous polymer, that is a main binder component, in the presence of the coloring material, the releasing agent, the additives, and the like.

The thus prepared heat-sensitive ink material is then coated on a support by solution coating or hot melt coating using a gravure coater, a wire bar, etc.

The heat-sensitive ink material may also be coated on a support by powder coating which comprises powderizing the ink material by spray-drying, grinding, and the like and then coating the powder by electrostatic powder coating, and the like. In this case, the coated powder may be subjected, if desired, to heat treatment, press treatment, solvent treatment or the like to thereby fix the powder ink on the support. The powder ink for powder coating may be prepared by polymerizing a monomer or monomers for the amorphous polymer in the presence of other components, such as coloring materials, additives, releasing agents, etc., by direct polymerization, such as suspension polymerization and emulsion polymerization.

Supports which can be advantageously used to include plastic films of polyesters (e.g., polyethylene terephthalate), polyimides, imide type copolymers, fluorine-containing polymers, polypropylene, etc.; thin sheets or films, such as condenser paper. These sheets, films or rolls may contain therein thermal property-improving agents for improving thermal conductivity, thermal stability, etc., parting agents, antistatic agents, electrical conductors, reinforcing materials, and the like.

The supports must be electrically resistant when used with the addition of electrical conductors such as carbon black, metal powders, etc. Such supports generate heat upon the application of electric power. The electrical conductor is preferably added in an amount of 10 to 40% by weight based on the weight of binder constituting the support which exhibits a certain electrical resistance with the electrical conductor, such as polyimide resins, polycarbonate resins. In the case using the heat-sensitive recording material having the electrically resistant support, the recording can be effected by contacting an electrode with the surface of the electrically resistant support opposite to the ink material layer which is in contact with an image-receiving material such as paper, applying voltage to the electrode, whereby the support generates heat at which the electric voltage is applied, and transferring the ink material at the heated areas onto the image-receiving material. For the image formation, the electrodes may be a single electrode in combination with a return-electrode layer, a power-supply electrode in combination with a return-electrode, and the like.

For recording by means of a thermal head, etc., heat resistance, running properties, and the like of the support can be improved by providing a layer containing silicone compounds, fluorine-containing compounds, a resin layer, a crosslinked polymer layer, a metal layer, a ceramic layer, or the like on the side which contacts with a thermal head. In the case, the recording is effected by contacting the ink material layer of the heat-sensitive recording material with an image-receiving material such as paper, applying thermal energy with a thermal head from the support side of the heat-sensitive recording material, and transferring the ink material at the heated areas onto the image-receiving material.

The aforesaid additives for the support may be incorporated into an outer layer. In particular, it is preferred that a layer of a parting agent such as low molecular weight polymers and wax is provided between the support and the ink material layer. The support may have a smooth surface or a roughened or grooved surface, or may be porous. In addition, a thermo-electric transducing element or a photothermal transducing element having a structure analogous to a thermal head may be directly used as a support on which a heat-sensitive ink material layer is provided.

The thickness of the support is appropriately selected depending on use and is usually from about 1 to about 200 μm in view of easiness on use. For improving resolving power, a preferred thickness of the support is from about 1 to about 10 μm. The thickness of the heat-sensitive ink layer is selected from about 0.5 to about 50 μm depending on use and is usually selected from about 1 to about 20 μm in view of easiness in use. An intermediate layer that controls adhesion may be provided between the heat-sensitive ink material layer and the support. Plural kinds of heat-sensitive ink materials having different physical properties may be coated on the support in layer to form a multi-layer construction or may be coated on the same plane in divided areas.

The thus prepared heat-sensitive recording material is heated according to applied signals by means of a thermal head, a laser beam or flash light or by directly passing electric signals, whereby the heat-sensitive ink material is transferred to materials on which recording is to be made, such as paper, films, etc., either in contact or not in contact with the recording material. It is possible to improve recording performance properties with the aid of mechanical forces, such as pressure and foaming, as well as electrical field, magnetic field, ultrasonic waves, solvents, and the like.

This invention will now be illustrated in greater detail with reference to the following examples, but it should be understood that they are not intended to limit the present invention. In these examples, all the parts and ratios are given by weight unless otherwise indicated.

EXAMPLE 1

| Heat-Sensitive Ink Material A: | |
|---|---|
| Paraffin wax (m.p. = 69° C.) | 85 parts |
| Softening agent (lubricant oil) | 5 parts |
| Blue pigment (C.I. Pigment Blue 15:3) | 10 parts |

The above components were melt mixed at 100° C., and the mixture was kneaded in a three-roll mill to prepare a heat-sensitive ink material.

| Heat-Sensitive Ink Material B: | |
|---|---|
| Polystyrene resin [number average molecular weight (Mn) = about 2,500; weight average molecular weight (Mw) = about 7,000; glass transition temperature (Tg) = about 50° C.] | 18 parts |
| Blue pigment (C.I. Pigment Blue 15:3) | 2 parts |
| Toluene | 80 parts |

The above components were kneaded in a ball mill at room temperature for 40 hours to prepare a heat-sensitive ink material.

Each of the resulting ink materials was coated on a 6 μm thick polyester film, being placed on a hot plate heated at 110° C. in the case of Heat-Sensitive Ink Material A, with a wire bar to a dry film thickness of 3 μm to produce Heat-Sensitive Recording Material A or B, respectively.

Heat-Sensitive Recording Materials C to H were produced in the same manner as described above but using Heat-Sensitive Ink Material C to H having the following compositions, respectively.

| | |
|---|---|
| Heat-Sensitive Ink Material C: | |
| Styrene/2-ethylhexyl acrylate copolymer (80/20: Mn = about 8,000; Mw = about 19,000; Tg = about 55° C.) | 18 parts |
| Blue pigment (C.I. Pigment Blue 15:3) | 2 parts |
| Toluene | 80 parts |
| Heat-Sensitive Ink Material D: | |
| Styrene/acrylic acid copolymer (90/10; Mn = about 5,000; Mw = about 13,000; Tg = about 90° C.) | 18 parts |
| Blue pigment (C.I. Pigment Blue 15:3) | 2 parts |
| Toluene | 80 parts |
| Heat-Sensitive Ink Material E: | |
| Styrene/2-ethylhexyl acrylate copolymer (80/20; Mn = about 14,000; Mw = about 45,000; Tg = about 65° C.) | 18 parts |
| Blue pigment (C.I. Pigment Blue 15:3) | 2 parts |
| Toluene | 80 parts |
| Heat-Sensitive Ink Material F: | |
| Styrene/butadiene copolymer (90/10; Mn = about 20,000; Mw = about 110,000; Tg = about 60° C.) | 18 parts |
| Blue pigment (C.I. Pigment Blue 15:3) | 2 parts |
| Toluene | 80 parts |
| Heat-Sensitive Ink Material G: | |
| Styrene/dimethylaminoethyl methacrylate copolymer (95/5; Mn = about 4,000; Mw = about 10,000; Tg = about 60° C.) | 18 parts |
| Blue pigment (C.I. Pigment Blue 15:3) | 2 parts |
| Toluene | 80 parts |
| Heat-Sensitive Ink Material H: | |
| Stylene/acrylic acid polymer (97/3; Mn = about 5,000; Mw = about 12,000; Tg = about 70° C.) | 18 parts |
| Blue pigment (C.I. Pigment Blue 15:3) | 2 parts |
| Toluene | 80 parts |

Each of Samples A to H was used for recording on a heat-sensitive transfer printer, FX P-6 (manufactured by Fuji Xerox Co., Ltd.), and typical recording characteristics were evaluated as follows:

Recording Sensitivity:

The energy (E) required for recording a dot having a size corresponding to that of a thermal head heating element ($\frac{1}{8}$ mm=125 μm) was measured.

Good: $E<0.9$ mJ/dot

Moderate: 0.9 mJ/dot $\leqq E<1.2$ mJ/dot

Poor: 1.2 mJ/dot $\leqq E$

Resolving Power:

The degree of filling-up of blanks among strokes of a Chinese character, particularly the one composed of a large number of strokes, was visually observed.

Transparency:

Transfer recording was effected on a sheet for overhead projector (an OHP sheet), and the recorded image was projected on a screen to evaluate the turbidity of the color.

Fixing Degree:

The recorded image was rubbed with fingers and a rubber eraser, and peeling of the ink or formation of stains around the image were observed.

The results obtained are shown in Table 1 below.

TABLE 1

| Sample | Recording Characteristics | | | |
|---|---|---|---|---|
| | Recording Sensitivity | Resolving Power | Trans-parency | Fixing Degree |
| A | good | moderate | poor | moderate to good |
| B | good | good | good | good |
| C | moderate | good | good | good |
| D | poor | good | good | moderate |
| E | poor | good | good | moderate |
| F | poor | good | good | moderate |
| G | good | good | good | good |
| H | moderate | good | good | good |

As is shown in Table 1 above, Sample A in which a conventional wax was used as a binder was somewhat excellent in recording sensitivity but caused filling-up of blanks among strokes of a Chinese character composed of many strokes to make the letter illegible. Further, rubbing on the transferred image with fingers caused stains around the image. To the contrary, Sample B according to the present invention provided clear prints free from filling-up of blanks while exhibiting recording sensitivity substantially equal to that of Sample A. Further, the transferred image did not undergo peeling of the ink or stain formation when rubbed. Furthermore, the projected image obtained from Sample B had a bright blue color free from turbidity whereas that obtained from Sample A had a cloudy dark blue color.

Making a comparison between Sample C and Sample E, it was confirmed that control of a number average molecular weight of the amorphous polymer contributed to improvement in recording sensitivity. Likewise, a comparison between Sample D and Sample H showed contribution of control of glass transition temperature to improvement in recording sensitivity.

EXAMPLE 2

A heat-sensitive recording material was produced in the same manner as for Sample B of Example 1 but using a heat-sensitive ink material having the following composition and coating to a dry thickness of 2.5 μm.

| | |
|---|---|
| Polyester resin ($\overline{M}n$ = about 2,500; $\overline{M}w$ = about 10,000; Tg = about 50° C.) | 16 parts |
| Coloring material (carbon black) | 4 parts |
| Toluene | 40 parts |
| Methyl ethyl ketone | 40 parts |

Recording characteristics of the resulting sample except for transparency were evaluated in the same manner as described in Example 1. As a result, a dot could be recorded with energy of about 0.85 ml/dot, i.e., about 1.4 times the energy required in the case of Sample A, the recorded dot size being the same as that of Sample A. Further, the recorded image had clear outlines and did not come off even when rubbed with fingers.

EXAMPLE 3

A heat-sensitive recording material was produced in the same manner as in Example 2 but using a heat-sensitive ink material having the following composition:

| | |
|---|---|
| Polyester resin (the same as used in Example 2) | 13.6 parts |
| Ester wax (m.p. = 77° C.) | 2.4 parts |
| Coloring material (carbon black) | 4 parts |
| Toluene | 40 parts |
| Methyl ethyl ketone | 40 parts |

Recording characteristics of the resulting sample except for transparency were evaluated in the same manner as described in Example 1. As a result, recording could be achieved with energy of about 0.7 mJ/dot, about 1.1 times the energy required in the case of Sample A, and the transferred image was equal to Example 2; in resolving power and fixing degree.

EXAMPLE 4

A heat-sensitive recording material was produced in the same manner as for Sample B of Example 1 but using a heat-sensitive ink material having the following composition:

| | |
|---|---|
| Polystyrene resin (the same as used in Example 1-B) | 16 parts |
| Ester wax (m.p. = 77° C.) | 2 parts |
| Coloring material (carbon black) | 2 parts |
| Toluene | 40 parts |
| Methyl ethyl ketone | 40 parts |

As a result of evaluation of recording characteristics as in Example 1, recording could be achieved with energy of about 0.7 mJ/dot, about 80% of that required in Sample B of Example 1, and the transferred image obtained was clear and had sufficient fixing strength.

EXAMPLE 5

A heat-sensitive recording material was produced in the same manner as for Sample B of Example 1 but using a heat-sensitive ink material having the following composition:

| | |
|---|---|
| Epoxy resin ($\overline{M}n$ = about 1,500; Tg = about 50° C.) | 18 parts |
| Coloring material (carbon black) | 2 parts |
| Toluene | 80 parts |

As a result of evaluation of recording characteristics as in Example 1, recording could be achieved with energy of about 0.8 mJ/dot, about 1.3 times the energy required in Sample A of Example 1, and the transferred image obtained showed sufficient resolving power and fixing degree.

EXAMPLE 6

A heat-sensitive ink material was prepared by kneading the composition shown in Table 2 below and 75 parts of toluene per 100 parts of the total ink material (including toluene) in a ball mill for 40 hours. The resulting heat-sensitive ink materials were designated as Sample Nos. 1 to 7.

Each of Sample Nos. 1 to 7 was coated on a 6 μm thick polyester film by wire bar coating to a dry thickness of 3 μm to produce a heat-sensitive recording material. Recording characteristics of these recording materials were evaluated in the same manner as described in Example 1, and the results obtained are shown in Table 3.

TABLE 2

| Component | Sample No. 1 | 2 | 3 | 4 | 5 | 6 | 7 |
|---|---|---|---|---|---|---|---|
| Styrene/2-ethylhexyl acrylate copolymer* (parts) | — | 80 | 75 | 65 | 55 | 40 | — |
| Styrene/dimethylaminoethyl methacrylate copolymer** (part) | — | — | — | — | — | — | 65 |
| Ester wax*** (part) | 80 | — | 5 | 15 | 25 | 40 | 15 |
| Carbon black (part) | 20 | 20 | 20 | 20 | 20 | 20 | 20 |

Note:
*80/20; $\overline{M}n$ = about 8,000; $\overline{M}w$ = about 19,000; Tg = about 55° C.
**95/5; $\overline{M}n$ = about 4,000; $\overline{M}w$ = about 10,000; Tg = about 60° C.
***m.p. = 77° C.

TABLE 3

| Sample No. | Recording Sensitivity | Resolving Power | Fixing Degree |
|---|---|---|---|
| 1 | good | moderate | poor |
| 2 | moderate | good | good to moderate |
| 3 | good | good | good |
| 4 | good | good | good |
| 5 | good | good | moderate to good |
| 6 | good | moderate to good | moderate |
| 7 | good | good | good |

As is shown in Table 3, Sample No. 1, in which a conventional wax is used as a binder, is excellent in recording sensitivity but causes filling-up of blanks among strokes of a Chinese character composed of many strokes. Further, rubbing on the transferred image with fingers causes stains around the image. Sample No. 2 containing the amorphous polymer as a binder but not containing a releasing agent has relatively low recording sensitivity as requiring heat energy to be applied to a thermal head about 1.6 times that required in Sample No. 1, but has good resolving power. Sample Nos. 3 to 7 containing both the amorphous polymer and the releasing agent provide clear prints free from filling-up of blanks while exhibiting recording sensitivity substantially equal to that of Sample No. 1. Further, the transferred image does not undergo peeling of the ink upon rubbing thereon. It can be seen from the results of Sample Nos. 5 and 6 that a mere increase in content of the releasing agent does not bring about any further appreciable effect on improving recording sensitivity but rather tends to deteriorate resolving and fixing properties. This means that the amount of the releasing agent to be added has a certain optimum range.

EXAMPLE 7

A heat-sensitive ink material was prepared by kneading the following components in a ball mill for 40 hours, and coated on a 6 μm thick polyester film to a dry thickness of 2.5 μm to obtain a heat-sensitive recording material.

| Heat-Sensitive Ink Material: | |
|---|---|
| Polyester resin ($\overline{M}n$ = about 2,500; $\overline{M}w$ = about 10,000; Tg = about 50° C.) | 16 parts |
| 12-Hydroxystearic acid | 2 parts |
| Blue pigment (C.I. Pigment Blue 15:3) | 2 parts |
| Toluene | 40 parts |

-continued

| Heat-Sensitive Ink Material: | |
|---|---|
| Methyl ethyl ketone | 40 parts |

When the resulting sample was used for recording on a heat-sensitive transfer printer, FXP-6 produced by Fuji Xerox Co., Ltd., a clearly outlined transferred image which was free from filling-up of blanks and did not cause stains due to rubbing, etc. could be obtained with energy to be applied to a thermal head about 1.1 times that required in Sample No. 1 of Example 6.

When recording was conducted on an OHP sheet, the resulting image exhibited satisfactory transparency and, when projected on a screen, showed a bright blue color free from turbidity.

EXAMPLE 8

A heat-sensitive ink material having the following composition was prepared in the same manner as in Example 6 and coated on a 6 μm thick polyester film to a dry thickness of 3 μm to obtain a heat-sensitive recording material.

| Heat-Sensitive Ink Material: | |
|---|---|
| Epoxy resin ($\overline{M}n$ = about 1,500; Tg = about 50° C.) | 16 parts |
| Ester wax (m.p. = 79° C.) | 2 parts |
| Coloring material (carbon black) | 2 parts |
| Toluene | 80 parts |

When the resulting sample was used for recording in the same manner as in Example 6, a clear image having satisfactory fixing strength could be obtained with energy to be applied to a thermal head about 1.1 times that required in Sample No. 1 of Example 6.

EXAMPLE 9

A heat-sensitive ink material was prepared by mixing and dispersing the following components in an attritor, and coated on a 6 μm thick polyester film by gravure coating to a dry weight coverage of 3.5 g/m$^2$ to obtain a heat-sensitive recording material.

| Heat-Sensitive Ink Material: | |
|---|---|
| Aromatic petroleum resin (Tg = about 50° C.) | 24 parts |
| Paraffin wax (m.p. = 69° C.) | 3 parts |
| Coloring material (carbon black) | 3 parts |
| Toluene | 70 parts |

When the sample was used for recording in the same manner as in Example 6, an extremely sharp and firmly fixed image showing high resolving power could be obtained.

EXAMPLE 10

A heat-sensitive ink material having the following composition was prepared and coated in the same manner as in Example 9 to obtain a heat-sensitive recording material.

| Heat-Sensitive Ink Material: | |
|---|---|
| Aliphatic petroleum resin (Tg = about 50° C.) | 24 parts |
| Ester wax (m.p. = 77° C.) | 1 parts |
| Paraffin wax (m.p. = 69° C.) | 2 parts |

-continued

| Heat-Sensitive Ink Material: | |
|---|---|
| Coloring material (carbon black) | 3 parts |
| Toluene | 70 parts |

As a result of recording in the same manner as in Example 6, an extremely sharp and firmly fixed image showing high resolving power could be obtained.

As described above, the heat-sensitive recording materials according to the present invention provide transferred images, particularly color images, excellent in reproducibility, recording sensitivity, transfer property, fixing property and resolving power.

Differing from crystalline waxes that have conventionally been used as binders for heat-sensitive recording materials, the amorphous polymers that are used in the present invention as binders completely prevent light scattering due to crystals or at least control such light scattering to a substantially negligible extent, to thereby impart extremely excellent transparency to the binder layer of the heat-sensitive recording materials of the invention.

In particular, when ink materials are printed in layers to obtain a clear color image, especially a pictorial image in full color by printing of magenta, yellow and cyan ink materials one after another to form a 2-color or 3-color (cyan, magenta, yellow), use of the heat-sensitive ink material of the invention in at least the upper ink layer makes it possible to obtain a color with no color difference from the intended 2- or 3-color (cyan, magenta, yellow) because the reflected light from the lower ink layer is near to the reflected light of its own color characteristics due to satisfactory transparency of the upper ink layer.

From the viewpoint of recording sensitivity, it has been considered disadvantageous to use high-molecular materials as a binder in place of the conventional waxes. Contrary to this anticipation, the heat-sensitive recording materials according to the present invention using a specific amorphous polymer as a binder can attain recording sensitivity equal to those using the conventional waxes, and can also eliminate dissipation of applied energy in a binder layer by taking advantage of characteristics of high-molecular weight materials, i.e., mild melt properties, to thereby obtain high resolving power. In addition, use of the polymers as a binder makes the resulting recording materials flexible and resistant to abrasion, etc. and improves fixing property that has been inferior in the conventional wax type heat-sensitive recording materials.

While the invention has been described in detail and with reference to specific embodiments thereof, it will be apparent to one skilled in the art that various changes and modifications can be made therein without departing from the spirit and scope thereof.

What is claimed is:

1. An image recording material for heat-sensitive hot-melt transfer recording comprising a support and transfer layer having transparency to visible light which comprises an amorphous polymer having a number average molecular weight of not more than about 5,000, a weight average molecular weight of not more than about 10,000 and a glass transition temperature of from about 50° C. to 80° C. and a coloring material as main components, said amorphous polymer being present in an amount of at least 80% by weight based on solid components of the transfer layer.

2. An image recording material as in claim 1, wherein said transfer layer further comprises a releasing agent.

3. An image recording material as in claim 2, wherein the weight ratio of the amorphous polymer to the releasing agent is from about 80/20 to about 99/1.

4. An image recording material as in claim 3, wherein said weight ratio is from about 80/20 to about 95/5.

5. An image recording material as in claim 2, wherein said releasing agent has a melting point or softening point of from 50° to 200° C.

6. An image recording material as in claim 5, wherein said releasing agent has a melting point or softening point of from 60° to 150° C.

7. An image recording material as in claim 2, wherein said releasing agent has such a low viscosity that the melt viscosity suddenly decreases to about 10 poises or less in a temperature range of from about 100° to about 180° C. and/or such a low surface energy as having a critical surface tension of about 40 dyn/cm or less.

8. An image recording material as in claim 1, wherein a layer of a parting agent is provided between the support and the transfer layer.

9. An image recording material as in claim 1, wherein said support is an electrically resistant support.

10. An image recording material as in claim 9 wherein said electrically resistant support comprises binder resin and an electrical conductor.

11. An image recording material as in claim wherein said amorphous polymer is a homopolymer or copolymer of at least one monomer selected from the group consisting of styrene, styrene derivatives, methacrylic acid, methacrylates, acrylic acid, acrylates, and butadiene.

12. An image recording material as in claim 11, wherein said styrene derivative is selected from the group consisting of vinyltoluene, α-methylstyrene, 2-methylstyrene, chlorostyrene, vinyl benzoate, sodium vinylbenzenesulfonate, and aminostyrene.

13. An image recording material as in claim 11, wherein said amorphous polymer is selected from the group consisting of a homopolymer of styrene or a styrene derivative, a copolymer of styrene and acrylic acid, methacrylic acid, an acrylate or a methacrylate, and an epoxy resin.

14. An image recording material as in claim 1, wherein said amorphous polymer is selected from the group consisting of polyesters, polyamides, and petroleum resins.

15. An image recording material for heat-sensitive hot-melt transfer recording capable of producing a clear color image, a high degree of transparency to visible light and a low degree of light scattering in the transfer layers, comprising a support and transfer layer which comprises an amorphous polymer having a number average molecular weight of not more than about 5,000, a weight average molecular weight of not more than about 10,000 and a glass transition temperature of from about 50° C. to 90° C. and a coloring material as main components, said amorphous polymer being present in an amount of at least 80% by weight based on solid components of the transfer layer.

16. A process for forming an image, which comprises, contacting an image recording material for heat-sensitive hot-melt transfer recording comprising a support and a transfer layer having transparency to visible light, with an image receiving material such that the transfer layer and the image-receiving material face each other, selectively applying heat energy from the support side of the image recording material, and transferring the transfer layer at the heated areas onto the image-receiving material, wherein said transfer layer comprises an amorphous polymer and a coloring material as main components, said amorphous polymer having a number average molecular weight of not more than about 5,000, a weight average molecular weight of not more than about 10,000 and a glass transition temperature of from about 50° C. to 80° C. and being present in an amount of at least 70% by weight based on solid components of the transfer layer.

17. A process for forming an image as in claim 15, wherein said image is a multi-color image, said image recording material is a first image recording material exhibiting a first hue, and said process comprises repeating the steps of claim 15 with a second recording material exhibiting a different hue such that at least a part of the second transfer layer transferred to the image-receiving material covers at least a part of the first transfer layer transferred to the image-receiving material.

18. A process for forming an image, which comprises contacting an image recording material for heat-sensitive hot-melt transfer recording comprising an electrically resistant support having provided thereon a transfer layer having transparency to visible light, with an image receiving material such that the transfer layer and the image-receiving material face each other, contacting an electrode on the support surface opposite to the transfer layer, selectively applying voltage through the electrode to generate heat in the support, and transferring the transfer layer at the heated areas of the support onto the image-receiving material, wherein said transfer layer comprises an amorphous polymer and a coloring material as main components, said amorphous polymer having a number average molecular weight of not more than about 5,000, a weight average molecular weight of not more than about 10,000 and a glass transition temperature of from about 50° C. to 80° C. and being present in an amount of at least 80% by weight based on solid components of the transfer layer.

19. A process for forming an image as in claim 18, wherein a layer of a parting agent is provided between the support and the transfer layer.

* * * * *